US006803704B2

(12) United States Patent
Motoi et al.

(10) Patent No.: US 6,803,704 B2
(45) Date of Patent: Oct. 12, 2004

(54) CHANNEL PLATE AND MANUFACTURING METHOD THEREOF

(75) Inventors: Taiko Motoi, Kanagawa (JP); Mitsuru Ohtsuka, Kanagawa (JP); Tohru Den, Tokyo (JP); Toshiaki Aiba, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 09/971,038

(22) Filed: Oct. 5, 2001

(65) Prior Publication Data

US 2002/0088714 A1 Jul. 11, 2002

(30) Foreign Application Priority Data

Oct. 6, 2000 (JP) ..... 2000-307240

(51) Int. Cl.[7] ..... H01J 43/04

(52) U.S. Cl. ..... 313/103 R; 313/528; 428/34.4; 428/98

(58) Field of Search ..... 313/528, 530, 313/532, 542, 103 R, 103 CM, 105 R, 379, 384, 135 R, 105 CM; 250/207, 214 VT; 428/34.4, 34.5, 328, 329

(56) References Cited

U.S. PATENT DOCUMENTS

| | | | | | |
|---|---|---|---|---|---|
| 3,657,596 | A | * | 4/1972 | Goetze et al. | 313/387 |
| 3,724,066 | A | * | 4/1973 | Wainer et al. | 29/592.1 |
| 4,039,887 | A | * | 8/1977 | McDonie | 313/346 R |
| 4,475,059 | A | * | 10/1984 | Sink | 313/534 |
| 5,015,909 | A | * | 5/1991 | Zhong et al. | 313/105 R |
| 6,005,334 | A | | 12/1999 | Mitome et al. | 313/309 |
| 6,259,191 | B1 | | 7/2001 | Mitome et al. | 313/310 |

FOREIGN PATENT DOCUMENTS

| | | |
|---|---|---|
| JP | 4-87247 | 3/1992 |

* cited by examiner

*Primary Examiner*—Ashok Patel
(74) *Attorney, Agent, or Firm*—Fitzpatrick, Cella, Harper & Scinto

(57) ABSTRACT

To provide a plate of high resolution and large area. The channel plate configured by including a substrate, a first electrode placed on the top face of the substrate, and a second electrode placed on the bottom face of the substrate, wherein the substrate is a porous element having a plurality of pores extending therethrough, and the porous element is formed by a compound including aluminum, and the porous element has an electron multiplier on a wall surface of the pore.

7 Claims, 4 Drawing Sheets

CHANNEL PLATE AND MANUFACTURING METHOD THEREOF

BACKGROUND OF THE INVENTION

1. Field of the Invention

The present invention relates to a channel plate used for an image intensifier, a photoelectron amplifier and so on and a manufacturing method thereof.

2. Related Background Art

An electron multiplier using a secondary electron emission phenomenon, such as a photomultiplier, is widely in the actual use. The electron multiplier has a mechanism having a channel comprised of an interior wall of a glass pipe or a ceramic pipe, wherein an electron accelerated by an electric field is collided against the surface of the wall of the channel to generate a plurality of secondary electrons. Such electron multipliers are made in micro-size and integrated in a high density so as to form a channel plate of a planar structure (also called a multi-channel plate, micro-channel plate and so on), which is used for an image device such as an image intensifier. In recent years, as requirements for the image device, not only more higher level of performance such as higher density, higher sensitivity, higher-speed operation and wider dynamic range, but also larger a size design more than the micro-size and a simple production method in order to provide a device with larger area and higher resolution. For that purpose, a large channel plate wherein electron multipliers are integrated in a density higher than the micro-size is required.

For higher resolution of channel plate, it is necessary to integrate individual electron multiplier in a high density. For that purpose, it is desired that channel wall thickness to each channel opening is small. Moreover, a plate having a stable channel wall hardly destructible over large area is required for a large-size channel plate that is larger than the micro-size.

The conventional electron multiplier uses glass such as lead glass and ceramics because of the necessity to form a tubular internal wall surface. The conventional multi-channel plate is formed by extending bundled glass pipes in a heated and softened state to form a plate having many pipes, or as shown in Japanese Patent Application Laid-Open No. 2000-113851, or, it is formed by coating a wire surface with diamond film, adhering the coated wire with an insulating substrate such as a plurality of adhesives, cutting the insulating substrate into plate-like elements, removing the wire by etching to form electrodes on both sides of the plate-like element respectively, or as shown in Japanese Patent Application Laid-Open No. 4-87247, it is formed by forming a pipe on a high lead glass substrate by etching and then heat-treating it in reducing gas atmosphere such as hydrogen.

FIG. 5 is a perspective view illustration showing configuration of the conventional channel plate. On a glass insulating substrate 21, a plurality of channels 22 are formed by etching, and a cathode electrode 24 and an anode electrode not shown therein are formed.

As for the conventional channel plate formed by using glass, it is necessary to decrease a diameter of the channel opening such that the diameter is smaller than the channel wall thickness in order to enhance strength of the glass to be the substrate. Accordingly, it is possible to make it larger but there is a limit to making it higher-resolution in the case of using a glass substrate as the substrate.

In addition, while the method of forming pores by cutting glass pipes or wires after bundling them in an adhesive layer and etching them is suitable for rendering a small plate higher-resolution, it is necessary to enhance adhesive strength against the etching for the purpose to allow the larger area design. Accordingly, the area occupied by the adhesive layer in the pore opening must be large enough. Moreover, in these methods, a semiconductor layer may be formed by heating the channel internal wall glass surface at high temperature in reducing atmosphere such as hydrogen. In such cases, a problem of heat strains due to high temperature heat treatment arises. Furthermore, as the wire to be a mold of the electron multiplier surface is removed by strong acid etching after forming a coating of diamond and so on, it was necessary to form the electron multiplier surface, which is the coating, as a robust coating that is maintained even without the wire.

SUMMARY OF THE INVENTION

The present invention was implemented in order to solve the problem set forth above, and its object is to provide a multi-channel plate that has high resolution and is advantageous for larger area, high resolution design and a manufacturing method thereof.

Another object of the present invention is to provide a channel plate having a structure of an electron multiplier surface capable of increasing a secondary electron multiplication factor and the manufacturing method thereof.

To be more specific, the channel plate according to the present invention is one having a porous element, and is characterized by the porous element including an aluminum compound.

In addition, the channel plate involved in a second invention of the present invention comprises: a substrate; a first electrode placed on the top face of the substrate; and a second electrode placed on the bottom face of the substrate, wherein the substrate is the porous element having a plurality of pores extending therethrough, and the porous element is formed with a compound including aluminum, and the porous element has an electron multiplier on a wall surface of the pore.

It is desirable that the above described electron multiplier emits secondary electrons due to collision of the electrons with the above described electron multiplier.

It is desirable that the above described electron multiplier has oxide grains of which secondary electron emission coefficient is larger than 1.

It is desirable that the above described porous element has aluminum oxide as its main ingredient.

It is desirable that the above described electron multiplier is formed by coating the wall surface of the pore of the above described porous element.

In addition, a third invention of the present invention is a channel plate manufacturing method comprising the steps of: anodizing aluminum or the substrate of which main ingredient is aluminum to form the porous element having a plurality of pores extending through the substrate; forming the electron multipliers on the wall surface of the pores; and forming the electrodes on the top and bottom faces of the porous element respectively.

It is desirable that the above described step of forming the electron multipliers is a step of coating the wall surfaces of the pores of the above described porous element with a coating layer including a material of which secondary electron emission coefficient is larger than that of the material forming the above described porous element.

It is desirable that the above described coating layer comprises a material of which secondary electron emission coefficient is larger than 1.

It is desirable that the above described aluminum or the substrate of which main ingredient is aluminum is an aluminum film disposed on the electrode to be anodized.

It is desirable that the above described coating layer includes oxide grains.

According to the present invention, it is possible to provide the channel plate wherein a channel having the electron multiplier surface of which electron multiplication factor is improved is formed over large area. It is possible, by using this channel plate, to acquire a large image intensifier of high resolution and large area, which can meet the demand for larger area design and higher performance in recent years.

DETAILED DESCRIPTION OF THE PREFERRED EMBODIMENTS

Figure 1A:
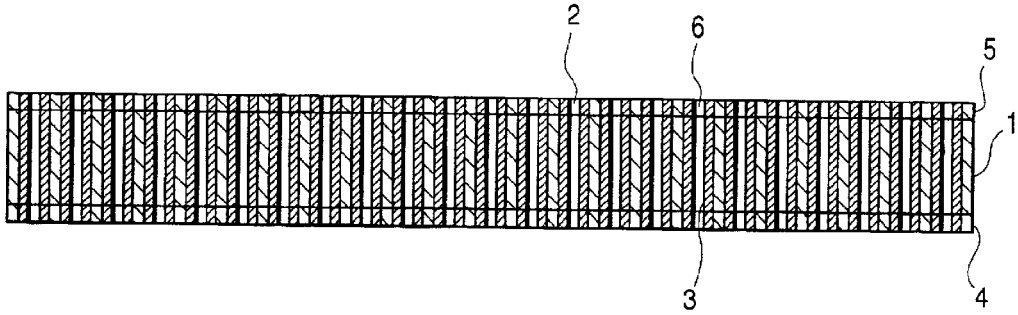
FIGS. 1A and 1B are schematic section views showing an embodiment of a channel plate of the present invention.

The present invention will be described in detail hereafter.

Channel plates of the present invention and a manufacturing method thereof will be described with reference to the drawings. Like portions in the drawings refer to the same reference symbols.

Figure 1B:
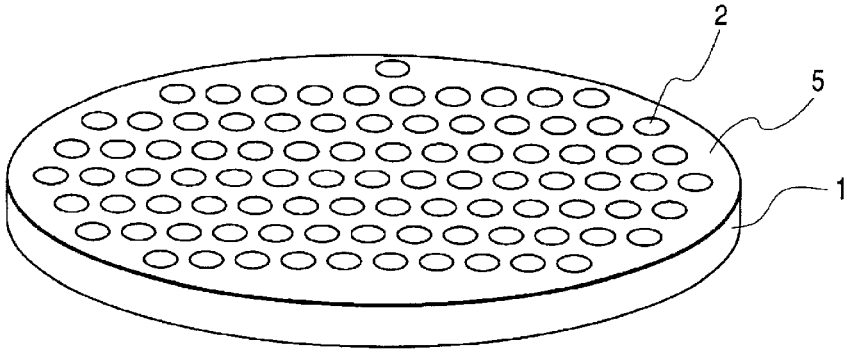

FIGS. 1A and 1B are illustrations showing an embodiment of the channel plate of the present invention, where FIG. 1A is a section view and FIG. 1B is a slanted view. As shown in FIGS. 1A and 1B, the channel plate of this embodiment is comprised of a channel 2 wherein a substrate 1 and a pore 6 provided in the substrate 1 are placed, and an electron multiplier 3 for emitting a secondary electron due to collision of the electron is formed on an internal wall surface of the pore 6, and a cathode electrode 4 and an anode electrode 5 provided on the top face and on the bottom face of the substrate 1 respectively for the purpose of applying voltage to the electron multiplier 3. And it is characterized by the substrate 1 comprised of a compound including aluminum.

The compound including aluminum referred to here is primarily a compound such as aluminum oxide, aluminum hydroxide, hydrate and so on generated from aluminum in an aqueous solution. As a matter of course, it may be a mixture of a plurality of these compounds. Moreover, in the case where a porous element is primarily composed as the aluminum oxide, the element is substantially an insulating substrate.

In addition, electron multipliers are placed on the internal wall surfaces of a plurality of pores, thus forming a so-called electron multiplier surface in a channel plate. It is desirable that the electron multiplier surface has oxide grains. This configuration increases microscopic asperities on the face of the electron multiplier surface and its surface area becomes larger than an even surface so that a secondary electron multiplication factor can be improved.

Moreover, a method of manufacturing the channel plate of the present invention is characterized by forming the wall surface of the channel by anodizing the aluminum.

In addition, it is characterized by having the steps of: anodizing in a solution the substrate of which main ingredient is aluminum to form a plurality of pores; having the pores extend through the substrate; coating the internal surfaces of the pores with high secondary electron emission material; and forming the electrodes on both faces of the substrate on which the pores are formed respectively.

Furthermore, it is characterized by the substrate of which main ingredient is aluminum being an aluminum film placed on the electrode to be anodized.

If an aluminum plate is anodized in the present invention, an anodic oxide alumina layer that is a porous anodic oxide film is formed. This porous film is characterized by having a unique geometrical structure wherein extremely minute columnar pores (nanoholes) of which diameter is between several nm and several hundreds nm are arranged in parallel with spacing of several tens of nm to several hundreds nm. These columnar pores have a high aspect ratio and also good uniformity of sectional diameters.

An insulating substrate 1 is comprised, for instance, of aluminum oxide or a mixture of aluminum hydroxide and so on, and as shown in a slanted view of FIG. 1B, the channel 2 in which an electron multiplier surface 3 is formed on the internal surface of the pore 6 extending through the substrate is placed, and the insulating substrate 1 is formed to be approximately several hundreds $\mu$m to 1 mm thick, and to have the diameter of 10 cm for instance in order to form a multi-channel plate.

The channel 2 has a diameter of several $\mu$m to several hundreds $\mu$m or so, and a million pieces or more of it are formed, for instance, in order to form the multi-channel plate for an image intensifier.

Moreover, the pores of the porous element may be formed substantially in a vertical direction from a top electrode 4 to a bottom electrode 5.

Figure 3:
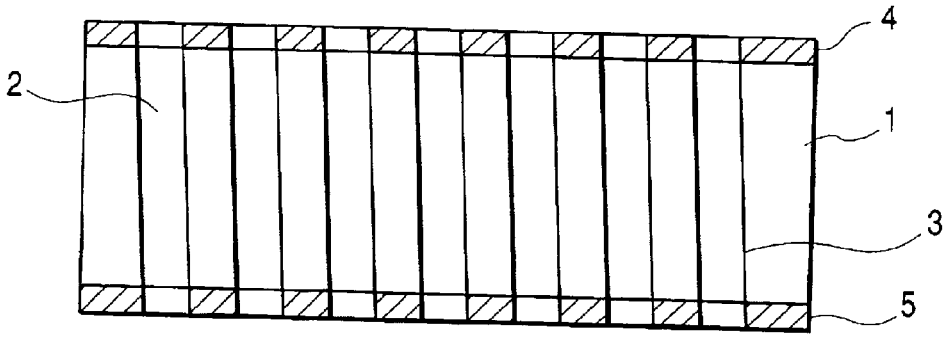
FIG. 3 is a schematic section view showing an embodiment of the channel plate of the present invention.

In addition, as shown in FIG. 3, the pores may be formed in a slanted direction to a thickness direction of the substrate so as to increase the number of the times that the electron collides with the pore wall surface. Or, it is also possible to render the pore diameter on the top face of the porous element different from that on the bottom face.

Figure 2:
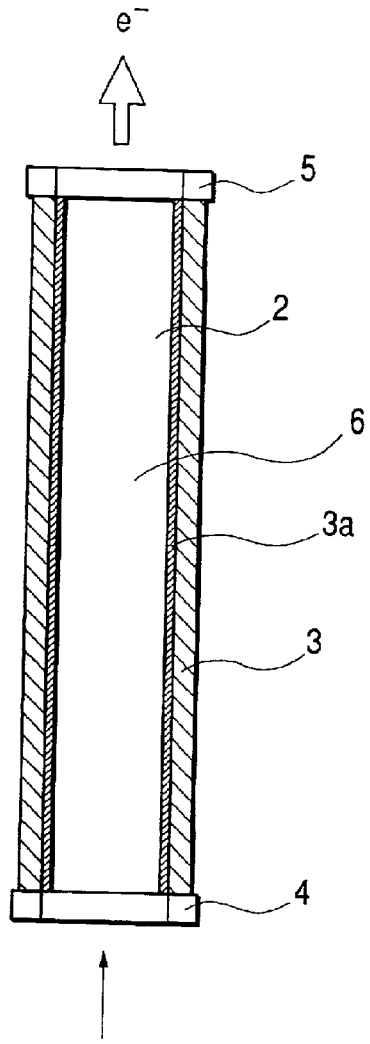
FIG. 2 is an enlarged section view of a single channel comprising the channel plate of FIGS. 1A and 1B.

FIG. 2 is an enlarged section view of a single channel comprising the multi-channel plate in FIGS. 1A and 1B. The internal wall surface of the pore 6 of each channel 2 is the electron multiplier surface 3, and the inside of the channel 2 is a hole. There are the asperities on the face of the electron multiplier surface 3, and formation of the asperities can dramatically enhance a nucleus occurrence density so as to improve the secondary electron multiplication factor.

It is easy to form a surface that is uneven with irregular asperities on the electron multiplier surface 3. For instance, as the pore that is the electron multiplier surface 3 has a grain 3*a* of an oxide or the like on its internal wall surface, it increases microscopic asperities on the face of the electron multiplier surface and the surface area thereof becomes larger than an even surface so that a secondary electron multiplication factor can be further improved.

The cathode electrode 4 and the anode electrode 5 are intended to apply a potential to the electron multiplier surface 3, and they are form with metals such as Au/Ti and Al to be approximately 0.1 to 0.5 $\mu$m thick.

The electrodes do not have to be formed in the entire area of the top and bottom faces of the porous element but only in part thereof.

The channel plate of the present invention has the channel including aluminum formed by regularized Al anodic oxidation.

The manufacturing method of the channel plate shown in FIGS. 1A and 1B will be described by referring to FIGS. 4A to 4D.

Figure 4A:
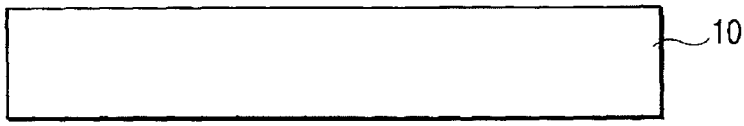
FIGS. 4A, 4B, 4C and 4D are diagrams showing manufacturing steps of the channel plate of FIGS. 1A and 1B.
Figure 4B:
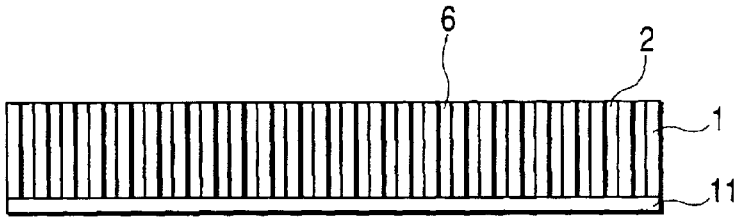

First, as shown in FIG. 4A, a substrate 10 of which main ingredient is Al that is the material of the insulating substrate 1 is soaked in an electrolyte for anodic oxidation to form the pore 6 as shown in FIG. 4B.

Here, the substrate of which main ingredient is Al is the material forming the pore by anodic oxidation and having a portion in which the metal Al is constituted with required area and thickness, where a metal Al plate and a board forming electrodes having an Al film piled up thereon and so on can be named. Moreover, other elements may be included as far as they can be anodized. In addition, a vacuum evaporation method by resistance heating, a sputtering method, a CVD method and so on may be used to form the aluminum film. However, a method capable of forming a film with a surface that is even to an extent is desirable.

The electrolyte is liquid for forming the pore while oxidizing the metal Al by applying desired voltage, for which an aqueous solution of phosphoric acid, oxalic acid, sulfuric acid and so on adjusted to a desired density is used. The spacing, depth and so on of the pores can be changed by controlling a current density and time. In the case of a pore forming method by anodic oxidation using aluminum, homogeneous and regular pore formation is possible by regularly forming desired asperities to be a starting point of the pore formation on the aluminum surface in advance. That is, as a concave portion on the aluminum surface is more easily oxidized, the aluminum dissolves as the oxidation progresses so that the pores are successively formed.

As a method of forming such regular asperities on the aluminum surface, a method whereby a focusing ion beam is used, a method whereby a stamp with the asperities is pressed on the aluminum surface, a method whereby a convex portion is regularly formed with a resist or something similar and so on can be named. In addition, the pore formation regularized over large area is possible by performing two-phase anodic oxidation. To be more specific, it is a method whereby a porous coating formed by the anodic oxidation is removed once and then the anodic oxidation is performed again so as to make the porous coating with the pores showing better verticality, linearity and independence. This method is using the fact that a concave on the surface of the Al plate created when removing the anodic oxidation coating formed by the first anodic oxidation becomes the starting point for the pore formation of the second anodic oxidation.

To be more specific, if an oxidation zone is etched after performing the anodic oxidation once and the anodic oxidation is performed again, the remainder of the first oxidation zone forms the asperities on the aluminum surface so that the pores are regularly formed.

Figure 4C:
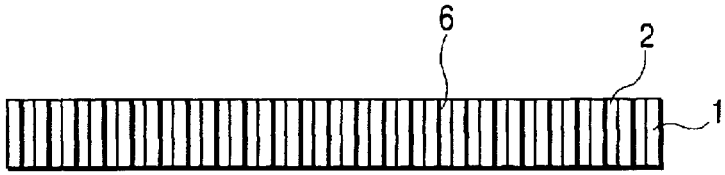

Thus, an extremely thin oxidation zone is left on a pore bottom 11 that is regularly formed. This zone is removed to have the pore extend through the substrate and form the channel 2 as shown in FIG. 4C. As for a method of removing the pore bottom 11, chemical etching, a method of physically shaving it and so on can be named. The pore diameter can be extended thereafter by performing a pore-widening process as required.

The inside of the pore 6 thus formed by the aluminum anodic oxidation forms an uneven surface with irregular and minute asperities. It is possible thereafter to have even more minute asperities formed inside the pore by coating the inside of the pore with grains. Thus, formation of the minute asperities inside the pore that is the electron multiplier surface 3 of the channel 2 increases the number of times of collision and scattering of the electrons incident inside the channel, and a form can be acquired, wherein the surface area of the electron multiplier surface becomes larger than the even surface so that the secondary electron emission efficiency can be improved.

As for a method of coating the grains on the electron multiplier surface, a method whereby they are soaked in solgel liquid, the CVD method and so on can be named.

In addition, it is desirable that, by selecting a material of which secondary electron emission factor is high as the grain material to be coated, the number of the secondary electrons generated by the electrons colliding with the electron multiplier surface increases. As for such materials of which secondary electron emission efficiency is high with its secondary electron emission coefficient larger than 1 for instance, the oxides such as BeO, MgO and BaO, diamond, graphite, carbon such as glassy carbon or a mixture of them and so on can be named.

Figure 4D:
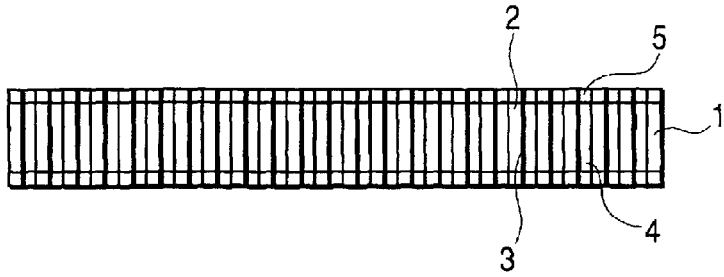
Figure 5:
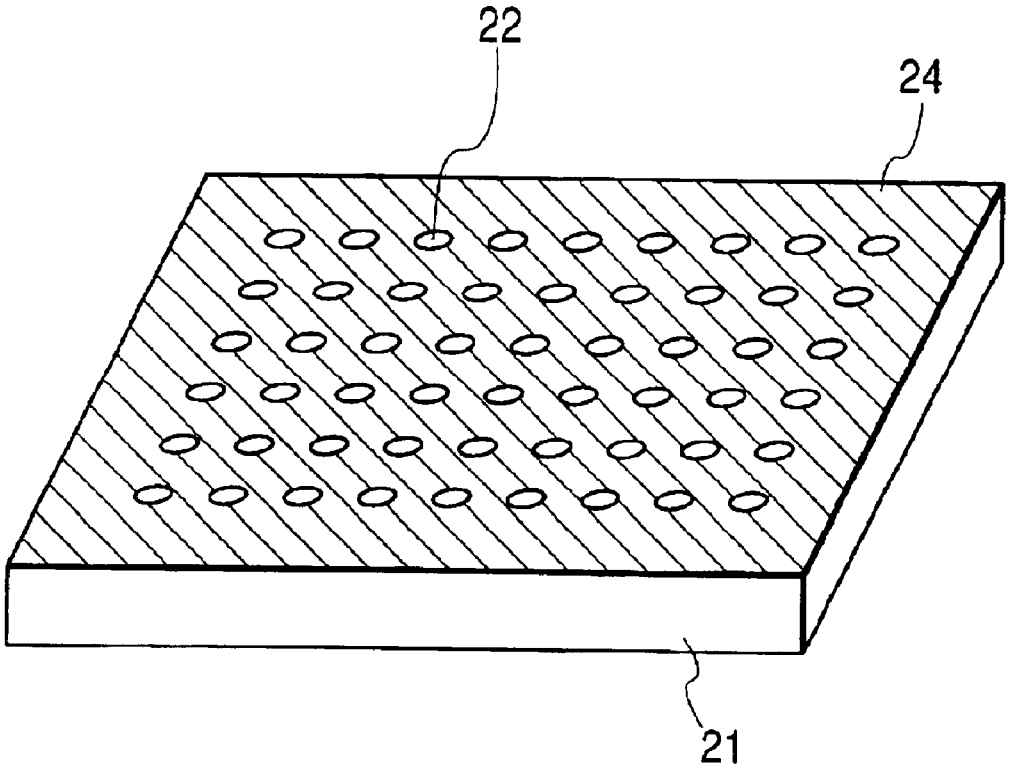
FIG. 5 PRIOR ART
FIG. 5 is a slanted view of a conventional channel plate.

Thereafter, as shown in FIG. 4D, the cathode electrode 4 and the anode electrode 5 can be formed on both faces of the insulating substrate 1 having the channel 2 thus formed so as to render it as a multi-channel plate.

The cathode electrode 4 and the anode electrode 5 are intended to apply a potential to the electron multiplier surface 3, and are formed by sputtering or vacuum evaporation of metals such as Au/Ti and Al to be approximately 0.1 to 0.5 $\mu$m thick. On this occasion, evaporation by a parallel beam of metallic atoms is performed so that the metal for the electrodes will not stick to the inside of the channel 2, and they are formed while having the metallic beam during the evaporation incident at a steep angle on the insulating substrate 1 on which the channel 2 is formed. Or, it is also possible to form it by a printing method not to close the pores of the channel 2.

According to the present invention, it is possible to form a strong and homogeneous channel over large area exceeding a micro-size by using aluminum as the material for forming the insulating substrate so that the channel plate of high resolution advantageous for the large area can be acquired.

In addition, it is possible to form the irregular and minute asperities on the electron multiplier surface inside the channel so as to acquire the high secondary electron multiplication factor.

Furthermore, according to the manufacturing method of the present invention, the insulating substrate having the channel is formed by regularized aluminum anodic oxidation, and so the channel having the electron multiplier surface of the high secondary electron emission efficiency can be easily formed over the large area in a high-resolution manner without undergoing a high temperature process.

Moreover, the above-mentioned channel plate may be applied to an X-ray diagnosing apparatus, an X-ray material inspection apparatus and so on.

(Embodiment)

The present invention will be described in detail by taking up an embodiment below.

Embodiment 1

The channel plate of a size of approximately 10 cm was produced.

It will be described hereafter by referring to FIGS. 4A to 4D.

First, the aluminum plate of approximately 12 cm in diameter was prepared as a material substrate 10 of the insulating substrate 1 (see FIG. 4A). As for the aluminum plate, one having purity of 99.9 percent or more aluminum was used. First, electrolytic polishing of the surface was performed in order to make the aluminum plate surface even. As for the electrolyte, a mixture of per-chlorous acid ($HClO_4$) and ethanol ($C_2H_5OH$) was used to perform it at 100 mA/cm$^2$ for three minutes.

Next, the pore 6 was formed on the substrate 10 by the aforementioned two-phase anodic oxidation.

An anodic oxidation condition for the first time was 195V, 10 hours in phosphoric acid aqueous solution of 0.3 M of which water temperature was kept at 0° C. Next, etching was performed in the mixture aqueous solution of chromic acid and phosphoric acid of which water temperature was kept at 60° C. for 10 hours or so to remove the anodic oxidation layer of the first time. Although the anodic oxidation layer was mostly removed, regular asperities were left on the aluminum plate surface.

Next, the aluminum substrate thus etched was anodized for the second time on the same condition as the first time. Thus, the insulating substrate 1 having regularly formed pores was formed (see FIG. 4B).

The extremely thin oxidation layer was left at the pore bottom 11. This zone was removed so as to have the pores extend through the substrate and form the channel 2 as shown in FIG. 4C. The etching was performed by soaking it in saturated $Hg_2Cl_2$ solution.

Thereafter, it was soaked in 10 wt % phosphoric acid solution for four hours and the pore widening process was performed to extend the pore diameter.

As a result of observing the insulating substrate formed on this condition with an electron microscope, the pores of approximately 250 nm in diameter were formed on the substrate of several hundreds $\mu$m in thickness.

The inside of the pore thus formed by the aluminum anodic oxidation formed the uneven surface with irregular and minute asperities.

Thereafter, the inside of the pore was coated with grains. MgO grains were formed by a solgel method. This formed even more minute asperities inside the pore to form the channel 2 having the electron multiplier surface 3 of which secondary electron emission efficiency is high.

Next, the cathode electrode 4 and the anode electrode 5 were formed on both faces of the insulating substrate 1 having the channel 2. It was formed by obliquely evaporating aluminum by the vacuum evaporation method. Thus, the channel plate was successfully produced (see FIG. 4D).

The channel plate using the nanoholes formed by the anodic oxidation has very narrow spacing between the pores so that it is the plate of higher resolution than conventional ones.

What is claimed is:

1. A channel plate, comprising:

a substrate having plural pores extending therethrough, each pore being defined by a respective inner wall surface of the substrate surrounding the pore;

a first electrode placed on an upper surface of the substrate;

a second electrode disposed along a lower surface of the substrate; and electron multipliers comprised of at least one of diamond, graphite, and carbon, or a mixture of at least one thereof, each electron multiplier being disposed along a corresponding inner wall surface of the substrate surrounding a corresponding pore.

2. A photomultiplier having the channel plate according to claim 1.

3. The channel plate according to claim 1, wherein each electron multiplier emits secondary electrons due to collision of electrons with the electron multiplier.

4. The channel plate according to claim 1, wherein each electron multiplier has oxide grains of which a secondary electron emission coefficient is larger than one.

5. The channel plate according to claim 1, wherein the substrate has aluminum oxide as a main ingredient.

6. The channel plate according to claim 1, wherein each electron multiplier is formed by coating the corresponding wall surface of the substrate surrounding the corresponding pore.

7. An image intensifier having the channel plate according to claim 1.

* * * * *